US009717292B2

(12) United States Patent
Johnson

(10) Patent No.: US 9,717,292 B2
(45) Date of Patent: Aug. 1, 2017

(54) KNEE PROTECTION DEVICE

(71) Applicant: Joseph E. Johnson, Frankfort, IL (US)

(72) Inventor: Joseph E. Johnson, Frankfort, IL (US)

( * ) Notice: Subject to any disclaimer, the term of this patent is extended or adjusted under 35 U.S.C. 154(b) by 0 days.

(21) Appl. No.: 14/666,485

(22) Filed: Mar. 24, 2015

(65) Prior Publication Data

US 2016/0278455 A1 Sep. 29, 2016

Related U.S. Application Data

(60) Provisional application No. 61/996,098, filed on Apr. 29, 2014.

(51) Int. Cl.

| | |
|---|---|
| ***A41D 13/00*** | (2006.01) |
| ***A41D 13/06*** | (2006.01) |
| *A41D 13/08* | (2006.01) |
| *A41D 13/05* | (2006.01) |

(52) U.S. Cl.

CPC ..... *A41D 13/065* (2013.01); *A41D 13/0562* (2013.01); *A41D 13/08* (2013.01)

(58) Field of Classification Search

CPC .. A41D 13/08; A41D 13/065; A41D 13/0568; A61F 5/0123

USPC ..... 2/16, 24, 62, 911; 602/26

See application file for complete search history.

(56) References Cited

U.S. PATENT DOCUMENTS

| | | | | | |
|---|---|---|---|---|---|
| 2,759,189 | A * | 8/1956 | Cole | A41D 13/0568 | 2/24 |
| 3,465,365 | A * | 9/1969 | Jones | A41D 13/0575 | 2/24 |
| 4,120,052 | A * | 10/1978 | Butler | A41D 13/0568 | 2/16 |
| 5,255,391 | A * | 10/1993 | Levine | A41D 13/0568 | 2/24 |
| 5,781,935 | A * | 7/1998 | Bassett | A41D 13/0568 | 2/16 |
| 6,402,712 | B1 * | 6/2002 | Gauvry | A61F 13/062 | 602/26 |

(Continued)

*Primary Examiner* — Tejash Patel
(74) *Attorney, Agent, or Firm* — Donald Flaynik

(57) ABSTRACT

A knee protection device includes congruently joined outer and inner cover members having cooperatively disposed arcuate configured portions disposed to minimize engagement between strap portions of the outer and inner cover members with a back portion of a knee portion of a leg of a person using the device. The device further includes an outer pad member fabricated from relatively pliable material and disposed adjacent to the outer cover member, and an inner pad member fabricated from relatively more pliable material than the outer pad member and disposed between the outer pad member and the inner cover member. The positions of the outer and inner pad members, relative to the outer and inner cover members, are maintained by thread inserted through the outer and inner cover members and adjacent to the pad members after the pad members have been centrally disposed between the cover members. The cover members are peripherally joined together, and hook and loop members are secured to end portions of the cover members to enable the end portions of the cover members to ultimately be secured about the back portion of the knee portion of the leg of a person using the device.

20 Claims, 12 Drawing Sheets

(56) References Cited

U.S. PATENT DOCUMENTS

| | | | | |
|---|---|---|---|---|
| 6,584,616 | B2 * | 7/2003 | Godshaw | A41D 13/0568 2/24 |
| 6,709,729 | B2 * | 3/2004 | Baruch | A01K 13/006 2/16 |
| 7,730,550 | B2 * | 6/2010 | Chiang | A41D 13/0568 2/24 |
| 7,797,759 | B2 * | 9/2010 | Cunningham | A41D 13/0568 2/24 |
| 7,987,518 | B2 * | 8/2011 | Calderwood | A41D 11/00 2/24 |

* cited by examiner

KNEE PROTECTION DEVICE

This application is based on U.S. Provisional Application No. 61/996,098 filed on Apr. 29, 2014.

BACKGROUND OF THE INVENTION

1. Field of the Invention

This invention relates to a knee protection device, and more particularly, to a device that includes an outer protection foam layer and an inner comfort foam layer, and wraps 360 degrees about a knee of a user to protect the knee and proximal tibia without pinching the back portion of the user's leg.

2. Background of the Prior Art

Knee protectors are well known and have a myriad of users including but not limited to construction workers such as cement finishers, sport participants and household project participants. The knee protectors are generally constructed of a relatively rigid, non-deformable outer member such as plastic to protect the knee from foreign objects, and a pad member with linear resistance characteristics on the inside of the rigid outer member that engages the knee to provide comfort to the user when the knee protector is strapped about knee portion of the user's leg. Alternatively, prior art knee protectors are fabricated from a foam pad inserted in a pocket in an annular elastic band that slides upon the knee portion of a user's leg when the user inserts his or her foot through the aperture in the annular elastic band.

A problem with the prior art knee protectors is that they do not include progressive resistance padding to provide increasing force attenuation characteristics as the padding is increasingly compressed, thereby providing more comfort to the user. Another problem with prior art knee protectors is that they do not include ergonomic curves in the straps that encircle the back portion of the knee to prevent the strap from pinching corresponding portions of the user's leg when the user is wearing the knee protector. Yet another problem with the prior art knee protectors is that they do not include a wrap member that detachably secures about the knee portion such that the elements of the knee protector that detachably join together are ultimately disposed proximate to a back portion of the knee. Still another problem with the prior art knee protectors is that they do not protect a back portion or a side portion of the knee from foreign objects that could engage the back portion or a side portion of the knee during normal use of the knee protector after the knee protector is secured to the user's knee.

SUMMARY OF THE INVENTION

It is an object of the present invention to overcome many of the disadvantages associated with prior art knee protection devices. A principal object of the present invention is to provide a knee protection device having progressive resistance padding. A feature of the knee protection device is the inclusion of a high density deformable resilient material disposed adjacent to a surface that the user of the device ultimately kneels upon. Another feature of the knee protection device is inclusion of a low density deformable resilient material disposed between the high density material and the knee of the user. An advantage of the knee protection device is that the high and low density materials cooperatively deform about the knee configuration of the user, thereby increasing knee protection via the high density deformable material and increasing the relative level of comfort afforded the knee via the low density deformable material.

Another object of the present invention is to provide increased knee protection to the user as the user's downward motion accelerates when the user kneels upon a surface. A feature of the knee protection device is the use of high and low density deformable resilient materials having progressive resistance characteristics. An advantage of the knee protection device is that as the user kneels upon a surface while wearing the device, the increased force generated via gravity is absorbed by the high and low density materials deforming less as the materials are compressed more.

Still another object of the present invention is to provide a knee protection device with a securing member that wraps around a knee portion of the user without pinching the back of the user's leg. A feature of the knee protection device is a securing member having curved or arcuate portions that reduce the surface area of the securing member from a maximum area adjacent to the deformable resilient materials to a reduced surface area directly behind the knee of the user. An advantage of the knee protection device is that the arcuate portions of the securing member cooperate with reduced surface area of the securing member snugly disposed upon a back portion of the user's leg to prevent the securing member from "pinching" or otherwise engaging the user's leg such that wearing the device is uncomfortable or painful to the user. Another advantage of the knee protection device is that the 360 degree wrap around feature of the securing member prevents foreign objects from engaging the back or the side of the user's leg covered by the securing member, thereby protecting the user's skin and/or clothing from any dirt, debris or liquids that would otherwise be encountered.

Yet another object of the present invention is to provide a protection device that can be used to protect a predetermined portion of the user's anatomy without including a securing member when the user is performing activities that require minimal movement by the user. A feature of the protective device is a retaining member that secures inner and outer cover members about high and low density deformable resilient materials without the presence of a securing member. An advantage of the protection device is that the device can be configured and dimensioned to receive a user's body part (typically a knee, elbow or hand) and disposed upon a surface such that the high density material is adjacent to the surface and the low density material is adjacent to the knee or elbow, thereby protecting the knee or elbow of the user when the user is engaged in work or athletic activities.

Briefly, the invention provides a knee protection device that includes an outer cover member having cooperatively disposed arcuate configured portions and an inner cover member having cooperatively disposed arcuate configured portions. The cooperating arcuate configured portions of the outer and inner cover members are congruently joined and disposed to minimize engagement between strap portions of the outer and inner cover members with a back portion of a knee portion of a leg of a person using the device. The device further includes an outer pad member fabricated from a relatively high density, deformable, resilient material. The outer pad member is ultimately disposed adjacent to the outer cover member. An inner pad member is also included and is fabricated from a relatively low density, deformable, resilient material. The inner pad member is disposed between the outer pad member and the inner cover member. The device requires elements that maintaining the position of the outer and inner pad members relative to the outer and inner cover members, and elements that integral join together peripheral portions of the outer and inner cover members. The device also requires elements that secure the outer and inner cover members about the knee portion of the leg of the person using the device; whereby the outer and inner pad members are configured to form about the knee portion to protect front and side portions of the user's knee portion simultaneously with the outer and inner cover members being configured to minimize engagement between the outer and inner cover members and the back portion of the user's knee.

The invention further provides a method for protecting a knee portion of a person's leg that includes:

selecting at least one layer of a progressive resistance energy absorbing material;

selecting at least one layer of pliable material disposed between the at least one layer of progressive resistance energy absorbing material and the knee portion, the progressive resistance energy absorbing material and the pliable material ultimately forming about front and side portions of the knee portion, thereby minimizing the force imparted upon said at least one layer of progressive resistance energy absorbing material from being transferred to the knee portion;

maintaining the position of the at least one layer of progressive resistance energy absorbing material relative to the knee portion, and the position of the at least one layer of pliable material relative to the knee portion; and securing the at least one formed layer of progressive resistance energy absorbing material and the at least one formed layer of pliable material about front and side portions of the knee portion of a person's leg, the securing means including arcuate portions that cooperate to minimize the binding of end portions of the securing means upon a back portion of the knee portion of a person's leg.

The invention also provides a body protection device that includes:

an outer cover member;

an inner cover member;

an outer pad member fabricated from a relatively high density, deformable, resilient material, the outer pad member being disposed adjacent to the outer cover member;

an inner pad member fabricated from a relatively low density, deformable, resilient material, the inner pad member being disposed between the outer pad member and the inner cover member;

elements for maintaining the position of the outer and inner pad members relative to the outer and inner cover members; and elements for integrally joining together peripheral portions of the outer and inner cover members, whereby the outer and inner pad members are configured to form about a predetermined body portion of a user to protect front and side portions of the predetermined body portion.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
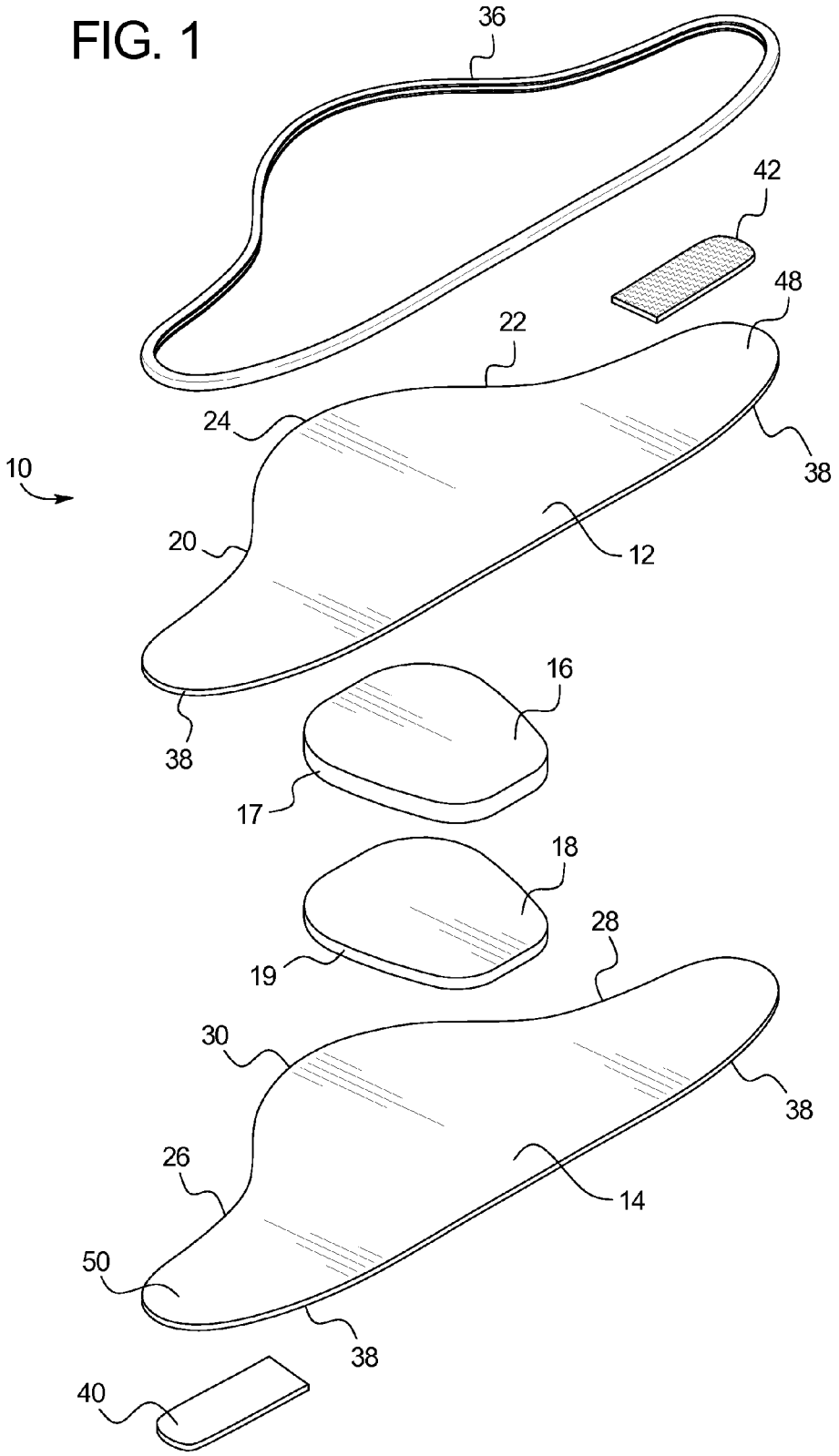
FIG. 1 is an exploded perspective view of a knee protection device in accordance with the present invention.

A knee protection device for protecting a person's knee and proximal tibia when kneeling on a surface in accordance with the present invention is denoted by numeral 10. Referring to the drawings, the device 10 includes outer cover member 12, inner cover member 14, outer pad member 16 and inner pad member 18 centrally secured between the outer and inner cover members 12 and 14. The outer cover member 12 includes first and second arcuate configured portions 20 and 22, and upper portion 24 that correspond to first and second arcuate portions 26 and 28, and upper portion 30 of the inner cover member 14. The device 10 is ultimately configured by congruently aligning and securing the outer and inner pad members 16 and 18 centrally between the outer and inner cover members 12 and 14 such that the outer pad member 16 is between the outer cover member 12 and the inner pad member 18, then congruently aligning and peripherally securing the outer and inner cover members 12 and 14 together.

The knee protection device 10 further includes a nylon stitching thread 31 or thread fabricated from similar material for forcibly maintaining the position of the outer and inner pad members 16 and 18 relative to the outer and inner cover members 12 and 14. The stitching thread 31 is disposed relatively parallel to opposing covered side walls 33 to form an "angular" configuration, when taking a front elevation view of the device (see FIG. 2), of the congruently aligned outer and inner pad members 16 and 18. An alternative location 32 for the stitching thread 31 for maintaining the position of the outer and inner pad members 16 and 18 relative to the outer and inner cover members 12 and 14, is adjacent to and snugly about the periphery of the congruently aligned and covered outer and inner pad members 16 and 18. A stitching thread 34 and peripheral strip member 36 are used for integrally joining together peripheral portions 38 of the outer and inner cover members 12 and 14. The strip member 36 is fabricated from material included in the group consisting of polyester, spandex, lycra, nylon and combinations thereof. The strip member 36 ultimately provides more "grasping" force to secure the peripheral portions 38 together.

Figure 3:
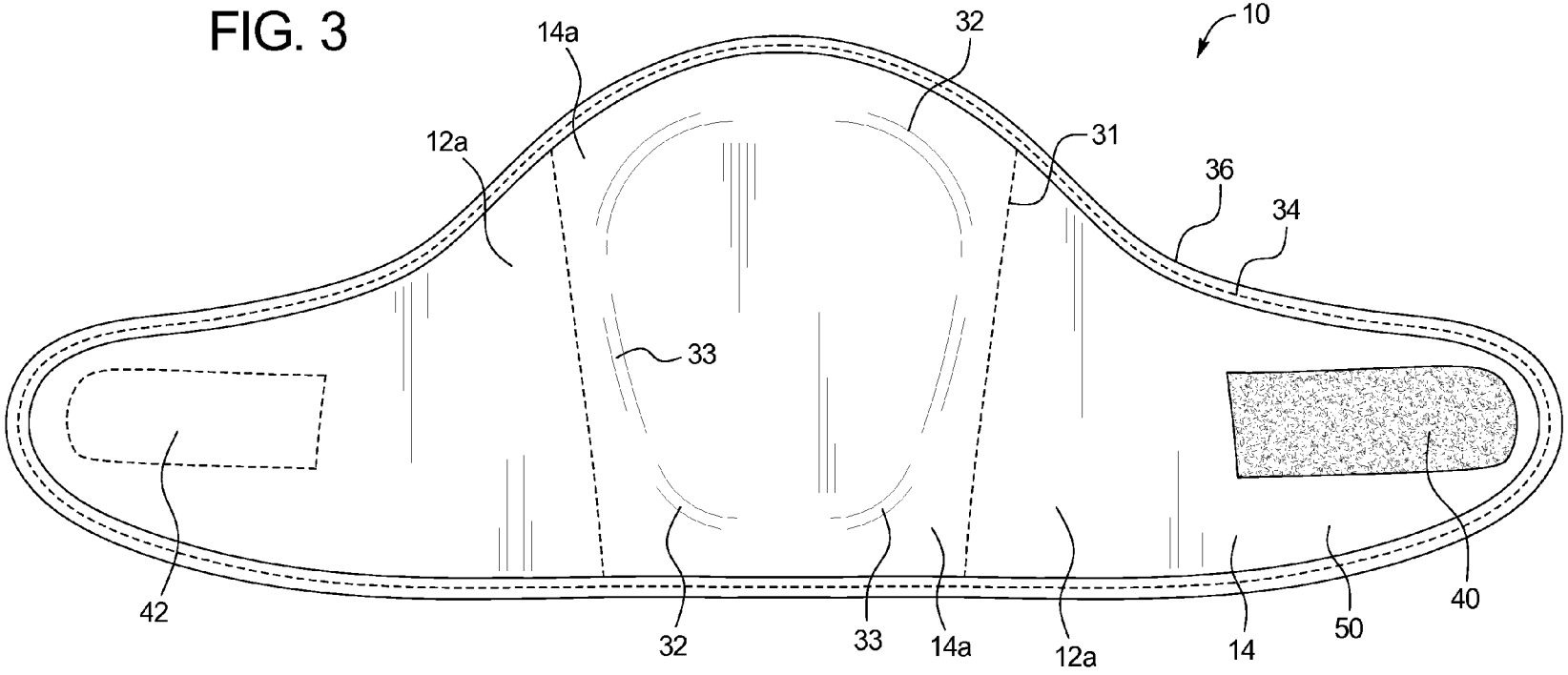
FIG. 3 is a back elevation view of the device of FIG. 1.
Figure 4:
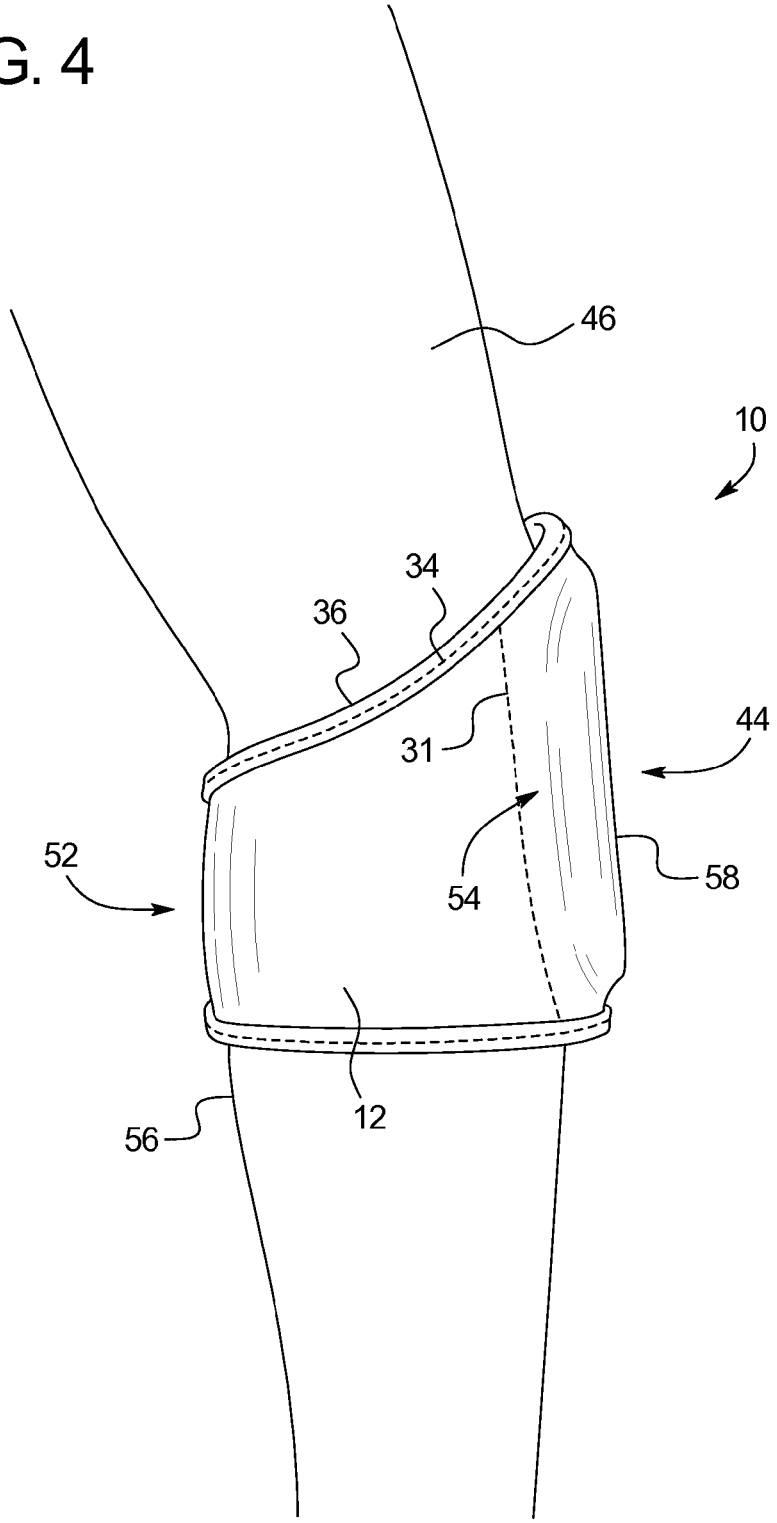
FIG. 4 is a side elevation view of the device of FIG. 1 wrapped about a knee portion of a person's leg in accordance with the present invention.
Figure 5:
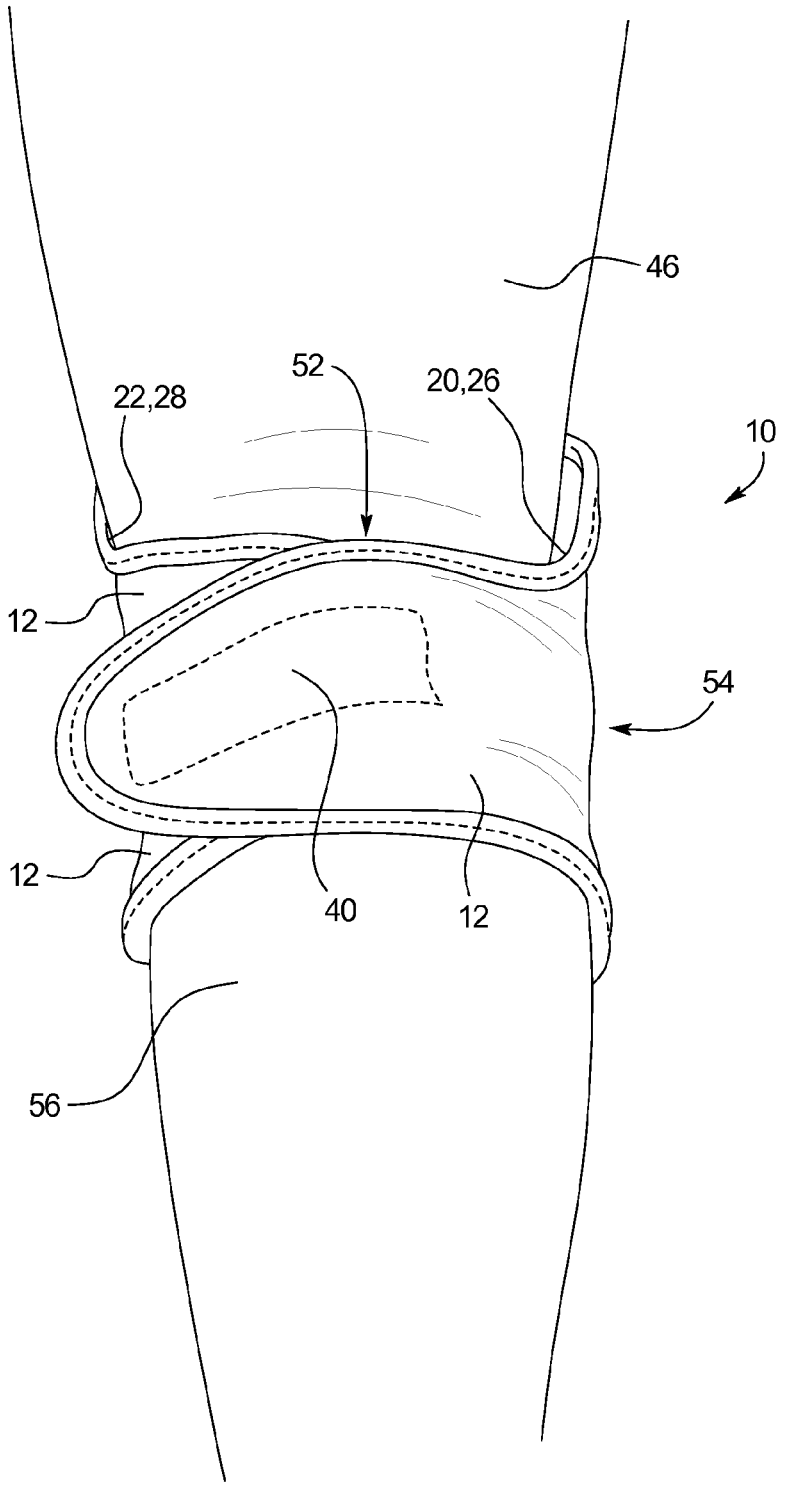
FIG. 5 is back elevation view of the device of FIG. 4.
Figure 6:
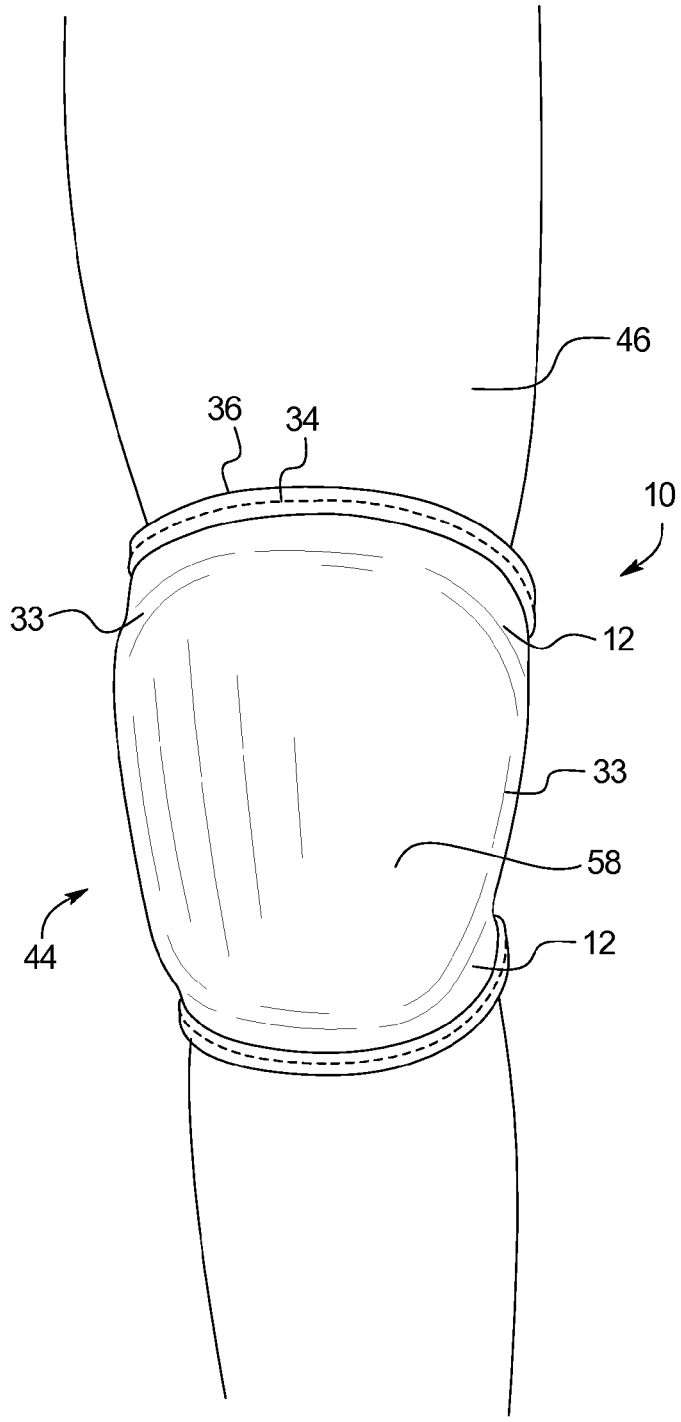
FIG. 6 is a front elevation view of the device of FIG. 4.
Figure 7:
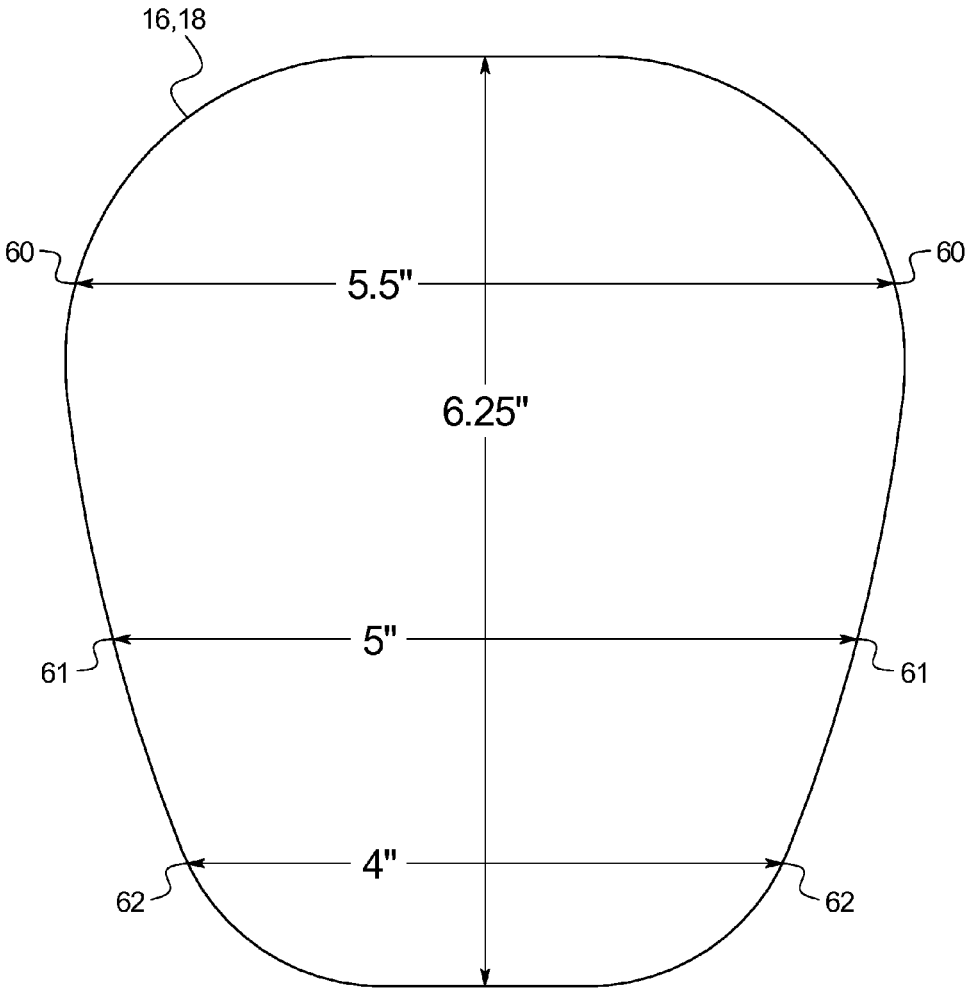
FIG. 7 is a front elevation view depicting dimensions for corresponding portions of outer and inner pad members of the device of FIG. 1 in accordance with the present invention.

An alternative configuration for the inner cover member 14 is depicted by periphery of the stitching thread 31 intersecting the strip member 36 in FIG. 3. More specifically, the inner cover member 14 covers only a mid-portion 14*a* of the outer cover member 12 rather than the entire back wall 12*a* of the outer cover member 12. The reduced area covered by the smaller inner cover 14*a* over the outer and inner pads 16 and 18, and part of the back wall 12*a* of the outer cover 12, correspondingly reduces the manual force required to wrap the device 10 about the knee 44 of the user and allows the device to return to its normal relatively planar configuration when not in use, thereby extending the useful "life" of the device 10 by maintaining its support characteristics.

Figure 2:
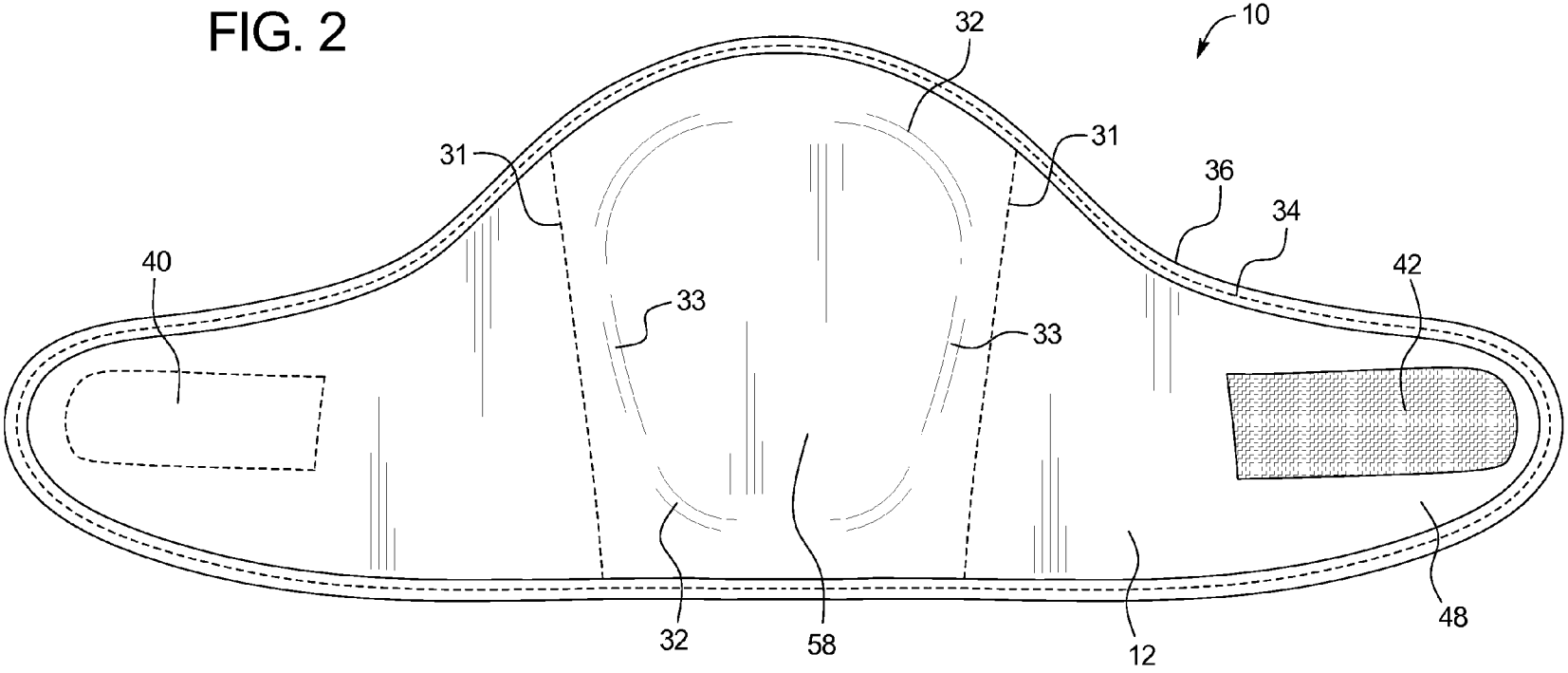
FIG. 2 is a front elevation view of the device of FIG. 1.

The advantage of using angular stitching 31 of FIG. 2 is that the outer and inner pad members 16 and 18 are allowed to longitudinally move in tandem while the device 10 is wrapped about a user's knee 44 while in motion, resulting in the maintaining of the planar alignment of the outer and inner pad members 16 and 18 with the outer and inner cover members 12 and 14. Further, the angular stitching 31 maintains the vertical and horizontal positions of the outer and inner pad members 16 and 18 relative to the outer and inner cover members 12 and 14, irrespective of the orientation of the user's knee 44 and the device 10 wrapped thereupon. The angular stitching 31 also prevents twisting and the undulating orientation of the congruently and adjacently disposed outer and inner pad members 16 and 18 inside the congruently joined outer and inner cover members 12 and 14, irrespective of user's knee 44 movement. The goal of the outer and inner pad members 16 and 18 movement is to maintain the safety and the comfort of the user's knee 44 while wrapped in the device 10.

The device 10 further includes hook and loop materials 40 and 42 for securing the outer and inner cover members 12 and 14 about a knee portion 44 of the leg 46 of a person. The hook and loop materials 40 and 42 are manufactured by Velcro and are integrally secured by thread to cooperating opposing end portions 48 and 50 of the outer and inner cover members 12 and 14. The end portions 48 and 50 are ultimately secured about a back portion 52 of the knee portion 44 such that the outer and inner pad members 16 and 18 are configured to form about the knee portion 44 to comfortably protect front and side 54 portions of the knee portion 44, while correspondingly aligned arcuate configurations 20, 22, 26 and 28 of the outer and inner cover members 12 and 14 lower the end portions 48 and 50 upon the "calf" or gastrocnemius muscle (not depicted) of the lower leg 56, thereby minimizing irritation of the back portion 52 of the knee portion 44 by minimizing the engagement area formed by the joined outer and inner cover members 12 and 14, and correspondingly maximizing comfort for the back portion 52 of the knee portion 44. The outer and inner cover members 12 and 14 are dimensioned and configured to cause and overlap of the end portions 48 and 50 upon a back portion of the knee 52 with sufficient grasping force to maintain a front portion 58 of the device 10 upon the user's knee 44 without irritating the back portion 52 irrespective of the movement of the knee portion 44. Further, the dimensions and configuration of the outer and inner cover members 12 and 14 promote a 360 degree wrap about the knee portion 44 such that the device 10 protects corresponding portions of the knee 44 and leg 46 from foreign elements irrespective of the person being in a standing or kneeling position.

The outer cover member 12 is fabricated from a material substantially impervious to water that includes neoprene fabric covered with nylon fabric together substantially about 1.5 mm thick. The inner cover member 14 is fabricated from a relatively soft material with moisture-wicking properties that passes water therethrough. The inner cover member 14 material of fabrication includes the group consisting of polyester, spandex, lycra, nylon and combinations thereof. The arcuate configured portions 20 and 22 of the outer cover member 12 and the arcuate configured portions 26 and 28 of the inner cover member 14 cooperate to form a front portion 58 of the device 10 having longitudinal and lateral dimensions sufficient to cover a predetermined knee portion 44 of the leg 46.

The outer pad member 16 is fabricated from a relatively high density, deformable, resilient foam including but not limited to Ensolite IVI foam manufactured by Armacell or a mixture of PVC-NBR foam well known to those of ordinary skill in the art. The high density characterization of the outer pad member 16 is used to describe a foam that will not transfer the impact or force of a foreign object engaging an outer surface of the outer pad member 16 to an inner surface of the outer pad member 16, thereby absorbing the impact or force and preventing the user's knee from experiencing any of the impact and corresponding discomfort. The inner pad member 18 is fabricated from a relatively low density, deformable, resilient foam including but not limited to an open cell urethane PORON-4790-92 foam manufactured by Roger's Corporation or Polyurethane Memory Foam well known to those of ordinary skill in the art. The low density characterization of the inner pad member 18 is used to describe a foam that will transfer the impact or force of a foreign object engaging an inner surface of the inner pad member 18 to an outer surface of the inner pad member 18, thereby allowing an impact or force to be transferred to the user's knee if not for the presence of the outer pad member 16; however, the force transferring characteristic of the inner pad member 18 provides comfortable engagement between the user's knee and the device 10 when the user imparts all his or her weight upon the inner pad member 18. The outer and inner pad members 16 and 18 have substantially congruent configurations when taking a front elevation view of the device 10. The outer and inner pad members 16 and 18 include top portions 60 having lateral dimensions substantially about five and one-half inches, mid-portion 61 lateral dimensions of substantially about five inches, bottom portion 62 lateral dimensions of substantially about four inches, and longitudinal dimensions of substantially about six and one-quarter inches.

The outer pad member 16 includes a thickness or sidewall 17 dimension of substantially about five-eighths of an inch, and the inner pad member 18 includes a thickness or sidewall 19 dimension of substantially about three-eighths of an inch. All the aforementioned dimensions can be cooperatively varied to correspond to the size of a preselected knee portion 44, thereby providing an inner pad member 18 that contours about the knee portion 44 to provide a predetermined level of comfort to the knee portion 44, while concurrently providing an outer pad member 16 that contours about the inner pad member 18 to absorb a predetermined quantity of energy imparted upon the knee portion that would otherwise injure the knee portion 44. To insure that the outer and inner pad members 16 and 18 move in unison, irrespective of the energy imparted upon the knee portion 44, an adhesive is disposed upon the adjoining surfaces of the outer and inner pad members 16 and 18 to prevent the surfaces from separating, which would decrease the energy absorbing capability of the device 10.

In the event that the device 10 does not have energy absorbing parameters that meet the requirements of the user; the outer and inner pad members 16 and 18 can be replaced by members having multilayer configurations, progressive resistance characteristics or combinations thereof that function to absorb the predetermined energy imparted upon the device 10. More specifically, an outer member 16 having more than one layer and fabricated from denser materials than the outer pad member 16 materials specified above, can be used in cooperation with an inner member 18 having more than one layer and fabricated from the same inner member 18 material as specified above. Alternatively, only a multilayer outer member 16 may be used and the inner member 18 deleted from the device 10.

Another alternative device 10 is one that uses a progressive resistance material for the outer member 16 which may include multiple layers; and an inner member 18 fabricated from a single layer of the same pliable material specified for the inner member 18 described above. The progressive resistance material has a relatively low energy absorbing parameter when in a steady state position or non-compressed position, but when compressed due to a force imparted upon the device 10, the energy absorbing parameter of the progressive resistance material increases linearly or exponentially depending upon the anticipated force magnitude and the rate of change thereof imparted upon the device 10.

Figure 8:
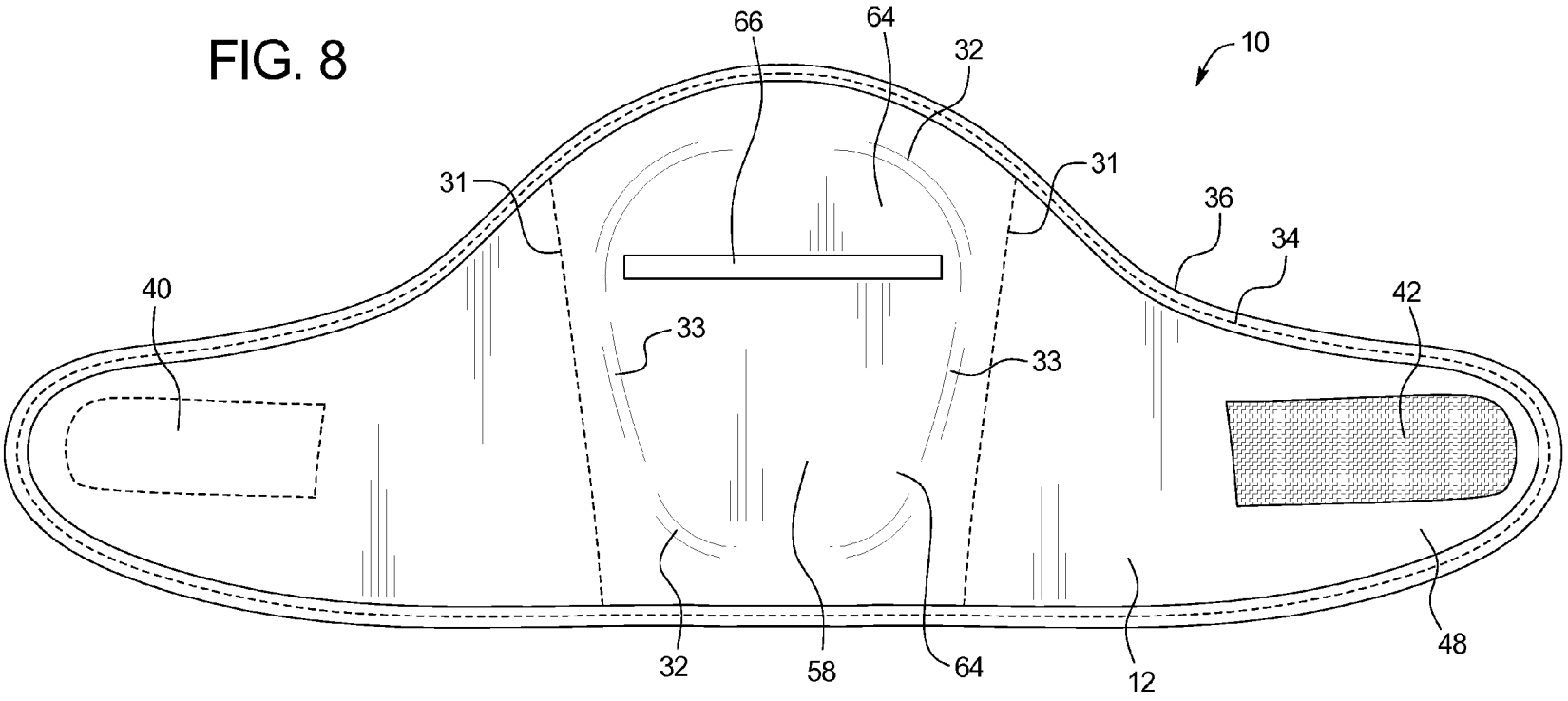
FIG. 8 is the same front elevation view of FIG. 2 but with a pocket added.
Figure 9:
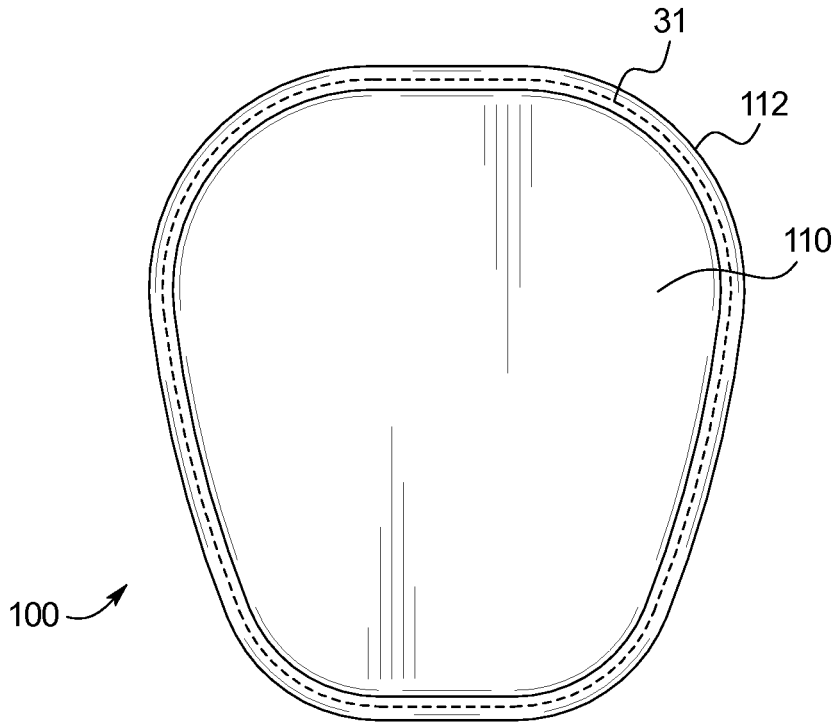
FIG. 9 is a front elevation view of an alternative embodiment of a knee protection device without a securing member in accordance with the present invention.
Figure 10:
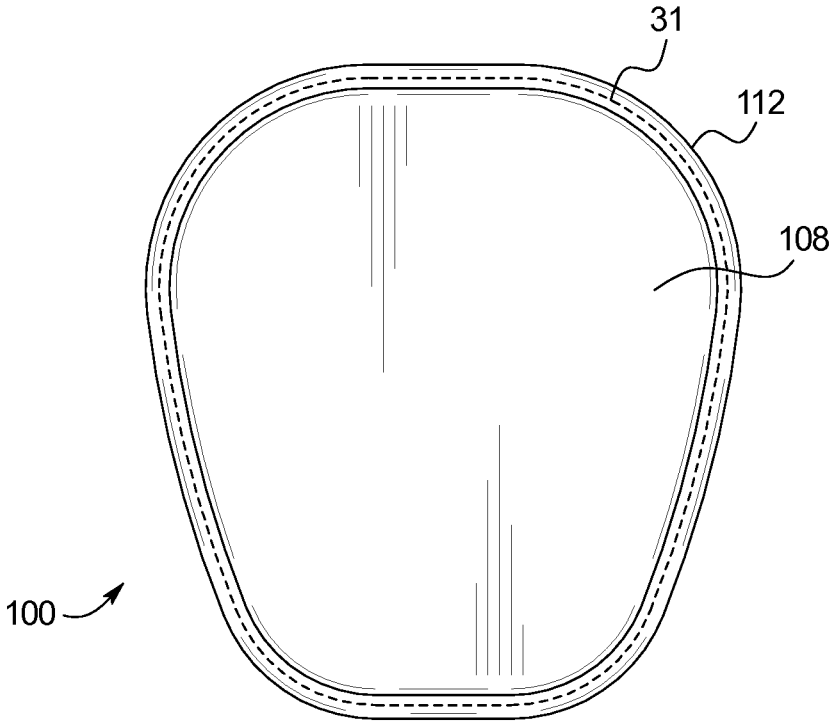
FIG. 10 is a back elevation view of the alternative embodiment of FIG. 9.
Figure 11:
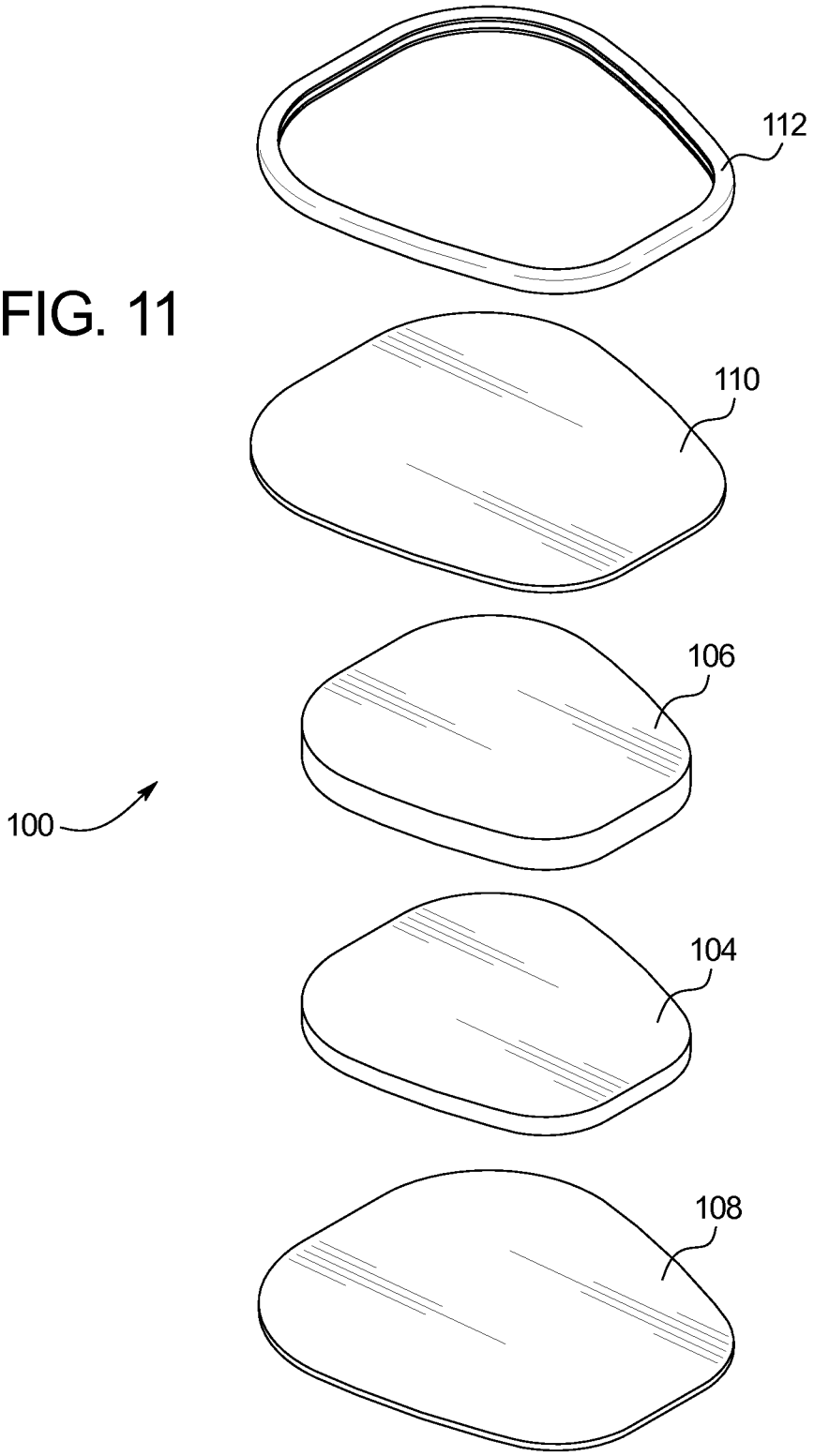
FIG. 11 is an exploded, perspective view of the device of FIG. 9.
Figure 12:
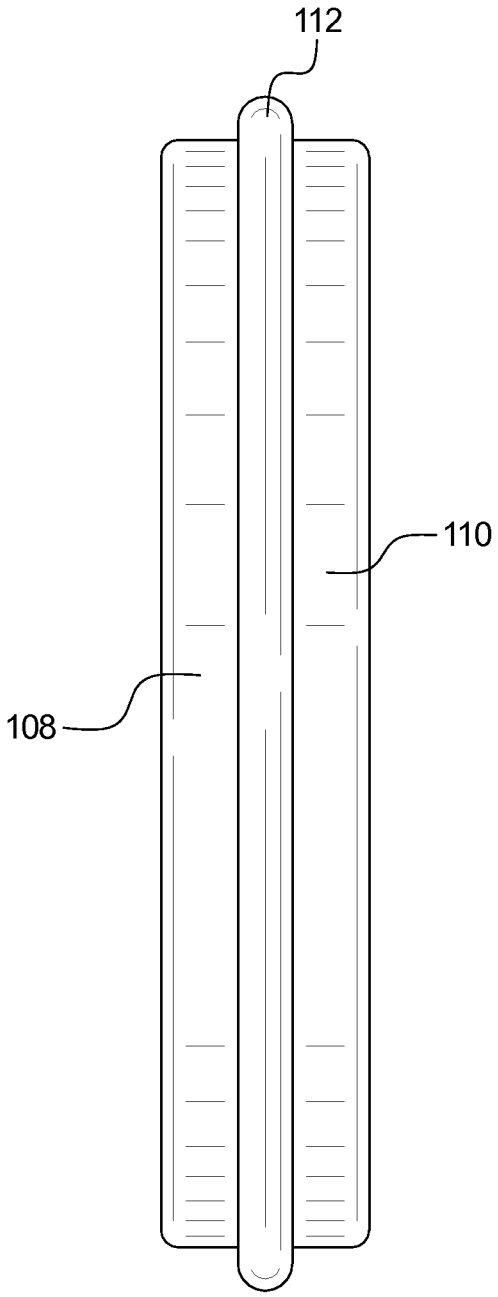
FIG. 12 is a side elevation view of the device of FIG. 9.

To provide a range of energy absorbing parameters for a single device 10, a pocket 64 (see FIG. 8) is formed in the mid-portion of the outer cover member 16. The pocket 64 is dimensioned and configured to snugly receive one or more layers of an outer member 16 fabricated from a predetermined energy absorbing material to protect the knee portion 44, and possibly one or more layers of an inner material 18 to promote a comfortable engagement between the device 10 and the knee portion 44 when the knee portion 44 is exposed to potentially damaging forces that would otherwise be imparted upon the knee portion 44 if not for the device 10 being disposed about the knee portion 44. The pocket 64 includes oppositely disposed strips 66 of hook and loop material that allows predetermined portions of the pocket to open and removably receive selected outer and inner members 16 and 18 such that when the strips 66 are joined, the outer and inner members 16 and 18 are snugly secured in the pocket 64 and efficiently function to absorb the energy from a potentially damaging force imparted upon the device 10.

Referring now to FIGS. 9-12, an alternative embodiment of the device 10 depicted in FIGS. 1-8 for protecting a person's knee in accordance with the present invention is denoted by numeral 100. The alternative device 100 is not wrapped about the user's leg. Instead the alternative device 100 is a cushioning device without straps and is ultimately disposed on a ground or floor surface. The device 100 is used to cushion and protect different body parts of the user such as elbows, knees and hands when the user performs activities that do not require much movement away from the original placement of the device 100. The user activities include but are not limited to yoga, gardening, prayer, work and the like. The alternative device 100 is less bulky and more discrete and more portable than the knee protection device 10 above.

The alternative device 100 includes inner and outer pad members 104 and 106 "sandwiched" between inner and outer cover members 108 and 110, and a retaining member 112 that secures a periphery of the inner and outer cover members 108 and 110 with the inner and outer pad members 104 and 106 therebetween such that the periphery of the inner and outer pad members 104 and 106 are not engaged by the retaining member 112.

The alternative device 100 may include a wrap member, which can have a myriad of configurations and dimensions to cooperate with predetermined body parts that typically include knees and elbows, but that also could include but not limited to forearms, wrists, ribs and groin. If the device 10 or alternative device 100 were to be used to protect an elbow, the configuration and dimensions of the device 10 and alternative device 100 would vary to snugly engage corresponding portions of the elbow. If a wrap member were to be used with either device 10 and 100, the wrap member would also be configured and dimensioned to snugly engage corresponding portions of the elbow. The wrap member can be fabricated from a myriad of materials including but not limited to neoprene fabric covered with nylon fabric together measuring substantially about 1.5 mm thick. Another wrap member material is an abrasion resistant nylon with the trade name Supertex manufactured by Macro International in Irvine Calif. Alternatively, a more "sticky" nylon can be used sold under the trade names "Cell Skin" or "Shark Skin."

The inner cover member 108 is fabricated from a relatively soft material with moisture-wicking properties that passes water therethrough. The inner cover member 108 material of fabrication includes the group consisting of polyester, spandex, lycra, nylon and combinations thereof. The outer cover member 110 is fabricated from a material substantially impervious to water that includes neoprene fabric covered with nylon fabric. Alternatively, the outer cover member 110 can be fabricated from the Supertex or Cell Skin trade names discussed above.

The inner pad member 104 can be fabricated from the same materials as the inner pad member 18 of the device 10 above with the material of choice being a Polyurethane Memory Foam. Alternatively, the inner pad member 104 can be fabricated from a low density, resilient, deformable material that reduces friction between the user's knee and the outer pad member 16, resulting in a "comfort" fit between the user's knee and the alternative device 100. The outer pad member 106 can be fabricated from the same materials as the outer pad member 16 of the device 10 above. Alternatively, the outer pad member 106 can be fabricated from a high density, resilient, deformable foam that protects the user's knee from foreign objects that would otherwise irritate the user's knee when the user kneels upon a floor or ground surface. The preferred material for fabricating the outer pad member 106 is a mixture of PVC-NBR foam well known to those of ordinary skill in the art.

The retaining member 112 is fabricated from material included in the group consisting of polyester, spandex, lycra, nylon and combinations thereof. The retaining member 112 includes an annular configuration dimensioned to engage a peripheral portion of the inner and outer cover members 108 and 110, such that the retaining member 112 secures peripheral edges of the inner and outer cover members 108 and 110 via a stitching thread 31 after the inner and outer pad members 104 and 106 have been disposed between the cover members 108 and 110.

The configurations and dimensions of the retaining member 112 and inner and outer cover members 108 and 110 cooperate to retain the positions of the inner and outer pad members 104 and 106 between the cover members 108 and 110 without compressing the pad members 104 and 106, which would reduce the protective features of the pad members 104 and 106. Further, after the retaining member 112 is secured to the wrap member, sufficient space is present between the cover members 108 and 110 and the pad members 104 and 106 to allow the combined cover members 108 and 110, and the pad members 104 and 106 to arcuately deform about the knee of the user to protect corresponding side portions of the user's knee.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. Knee protection device comprising:

an outer cover member having cooperatively disposed arcuate configured portions;

an inner cover member having cooperatively disposed arcuate configured portions, said cooperating arcuate configured portions of said outer and inner cover members being congruently joined and disposed to minimize engagement between strap portions of said outer and inner cover members with a back portion of a knee portion of a leg of a person using said device;

an outer pad member fabricated from a relatively high density, deformable, resilient material, said outer pad member being disposed adjacent to said outer cover member;

an inner pad member fabricated from a relatively low density, deformable, resilient material, said inner pad member being disposed between said outer pad member and said inner cover member;

means for maintaining the position of said outer and inner pad members relative to said outer and inner cover members;

means for integrally joining together peripheral portions of said outer and inner cover members; and means for securing said outer and inner cover members about the knee portion of the leg of the person using said device, whereby said outer and inner pad members are configured to form about the knee portion to protect front and side portions of the user's knee portion simultaneously with said outer and inner cover members being configured to minimize engagement between said outer and inner cover members and the back portion of the user's knee.

2. The device of claim 1 wherein said outer cover member is fabricated from a material substantially impervious to water.

3. The device of claim 2 wherein said outer cover member is fabricated from a neoprene fabric covered with a nylon fabric.

4. The device of claim 1 wherein said inner cover member is fabricated from a relatively soft material that passes water therethrough.

5. The device of claim 4 wherein said inner cover member is fabricated from the group consisting of polyester, spandex, lycra, nylon and combinations thereof.

6. The device of claim 5 wherein said inner cover member includes moisture-wicking properties.

7. The device of claim 1 wherein said corresponding arcuate configured portions of said outer and inner cover members cooperate to form a front portion of said device having longitudinal and lateral dimensions sufficient to cover a predetermined knee portion of the leg.

8. The device of claim 7 wherein said corresponding arcuate configured portions of said outer and inner cover members cooperate to form a back portion of said device that engages only an upper portion of the gastrocnemius muscle, thereby preventing the irritation of the back portion of the knee portion of the leg of the person using said device.

9. The device of claim 8 wherein said outer and inner cover members are configured and dimensioned to overlap upon a back portion of the knee with sufficient grasping force to maintain said front portion of said device upon the knee portion without irritating the back portion of the knee portion irrespective of the movement of the knee portion.

10. The device of claim 9 wherein said outer and inner cover members are configured and dimensioned to promote a 360 degree wrap about the knee portion of the leg such that the device protects corresponding portions of the knee and leg from foreign elements irrespective of the person in a standing or kneeling position.

11. The device of claim 1 wherein said outer pad member absorbs a predetermined quantity of energy to prevent injury to the user of the device.

12. The device of claim 1 wherein said means for maintaining the position of said outer and inner pad members includes a thread stitched through said congruently joined outer and inner cover members after congruently and centrally disposing said outer and inner pad members between said outer and inner cover members, said thread being snugly and adjacently stitched about the periphery of said congruently disposed outer and inner pad members such that the position of said pad members relative to said outer and inner cover members is forcibly maintained.

13. The device of claim 1 wherein said means for maintaining the position of said outer and inner pad members includes a thread stitched through said congruently joined outer and inner cover members after congruently and centrally disposing said outer and inner pad members between said outer and inner cover members, said thread being snugly stitched adjacent to side portions of said congruently disposed outer and inner pad members such that said stitched thread is relatively parallel to side walls of said congruently disposed outer and inner pad members when taking a front elevation view of said device, thereby allowing said outer and inner pad members to longitudinally move in tandem while the device is wrapped about a knee portion in motion, resulting in the maintaining of the planar alignment of the outer and inner pad members with the outer and inner cover members; the maintaining of the vertical and horizontal positions of said outer and inner pad members relative to the outer and inner cover members, irrespective of the orientation of the knee portion and the device wrapped thereupon; and the prevention of the twisting and the undulating orientation of the congruently and adjacently disposed outer and inner pad members inside the congruently joined outer and inner cover members, irrespective of knee portion movement to maintain the safety and the comfort of the knee portion.

14. The device of claim 1 wherein said outer and inner pad members are integrally and congruently joined together before being disposed between said outer and inner cover members.

15. The device of claim 1 wherein said means for integrally joining peripheral portions of said outer and inner cover members includes a peripheral strip member secured by thread about corresponding edge portions of the congruently joined outer and inner cover members.

16. The device of claim 1 wherein said means for securing said outer and inner cover members about the knee portion of the leg of a person includes hook and loop materials integrally secured to cooperating opposing end portions of said outer and inner cover members.

17. The device of claim 1 wherein said outer cover member includes a pocket re-sealable via cooperating hook and loop pocket strips, said pocket promoting the insertion of one or more layers of outer and inner pad members having energy absorbing parameters that ultimately protect the knee portion of a user from a varying range of forces imparted upon said device.

18. The device of claim 1 wherein said outer pad member material includes multilayer configurations, progressive resistance characteristics and combinations thereof.

19. A protection device for a knee portion of a person's leg comprising:

at least one layer of a progressive resistance energy absorbing material;

at least one layer of pliable material disposed between said at least one layer of progressive resistance energy absorbing material and the knee portion, said progressive resistance energy absorbing material and said pliable material ultimately forming about front and side portions of the knee portion, thereby minimizing the force imparted upon said at least one layer of progressive resistance energy absorbing material from being transferred to the knee portion;

means for maintaining the position of said at least one layer of progressive resistance energy absorbing material relative to the knee portion, and the position of said at least one layer of pliable material relative to the knee portion, said at least one layer of progressive resistance energy absorbing material and said at least one layer of pliable material secured about a back portion of the knee portion by said position maintaining means in combination with means for integrally joining peripheral portions of said at least one layer of progressive resistance energy absorbing material and said at least one layer of pliable material; and means for securing said at least one formed layer of progressive resistance energy absorbing material and said at least one formed layer of pliable material about front and side portions of the knee portion of a person's leg, said securing means including arcuate portions that cooperate to minimize the binding of end portions of said securing means upon a back portion of the knee portion of a person's leg.

20. Knee and elbow protection device comprising:

an outer cover member;

an outer pad member fabricated from a relatively high density, deformable, resilient material, said outer pad member being disposed adjacent to said outer cover member;

an inner pad member fabricated from a relatively low density, deformable, resilient material, said inner pad member being disposed between said outer pad member and said inner cover member;

an inner cover member relatively smaller than said outer cover member, said inner cover member covering said inner and outer pad members and a mid-portion of said outer cover member, said inner cover member being defined by angular stitching securing said inner cover member about the periphery of said inner and outer pad members, and securing said inner cover member to said mid-portion of said outer cover member, said peripheral angular stitching of said inner cover member allowing said inner and outer pad members to longitudinally move in tandem when said device is wrapped about a user's knee while in motion, resulting in the maintaining of the planar alignment of said inner and outer pad members with said inner and outer cover members, said relatively smaller inner cover member reducing the manual force required to wrap said device about a knee of a user, and allowing said device to return to a normal, relatively planar configuration when not in use to extend the useful life of said device;

means for maintaining the position of said outer and inner pad members relative to said outer and inner cover members; and means for integrally joining together peripheral portions of said outer and inner cover members, whereby said outer and inner pad members are configured to form about a predetermined body portion of a user to protect front and side portions of the predetermined body portion.

* * * * *